US005286930A

United States Patent [19]

Bittar et al.

[11] Patent Number: 5,286,930

[45] Date of Patent: Feb. 15, 1994

[54] VARIABLE ELEVATOR DOOR DWELL TIME BASED UPON TIME OF NOTIFICATION OF ASSIGNED CAR

[75] Inventors: Joseph Bittar, Avon; Zuhair S. Bahjat, Farmington, both of Conn.

[73] Assignee: Otis Elevator Company, Farmington, Conn.

[21] Appl. No.: 907,727

[22] Filed: Jul. 2, 1992

[51] Int. Cl.[5] ..... B66B 13/14

[52] U.S. Cl. ..... 187/103; 187/104; 187/133

[58] Field of Search ..... 187/104, 103, 130, 132, 187/133, 137

[56] References Cited

U.S. PATENT DOCUMENTS

| | | | |
|---|---|---|---|
| Re. 25,665 | 10/1964 | Nikazy | 187/103 |
| 2,835,346 | 5/1958 | Burgy | 187/103 |
| 4,724,933 | 2/1988 | Tsuji et al. | 187/137 |
| 4,784,240 | 11/1988 | Mac Donald et al. | 187/127 |
| 5,092,431 | 3/1992 | Schroder | 187/127 |

*Primary Examiner*—Steven L. Stephan
*Assistant Examiner*—Robert Nappi
*Attorney, Agent, or Firm*—Breffni X. Baggot

[57] ABSTRACT

Elevator door dwell time is varied as a function of arrival time so that a show-and-go time is met. The show-and-go time is the time from when the passengers are shown which elevator to board to the time when the elevator door is ready to close after the pasengers have entered the elevator. The arrival time is a function of the distance of the elevator from the floor of the hall call signal and is the time remaining after an elevator reaches a stop control point where a hall call assignment is fixed to a car until the door of said elevator begins to open. Door opening time, door dwell time, and arrival time are subtracted from a show-and-go time. If the difference is greater than or equal to zero, the door dwell time is increased by the difference, but if the difference is less than zero the door dwell time is decreased by the difference, and the doors are then held open at a landing for the door dwell time.

7 Claims, 2 Drawing Sheets

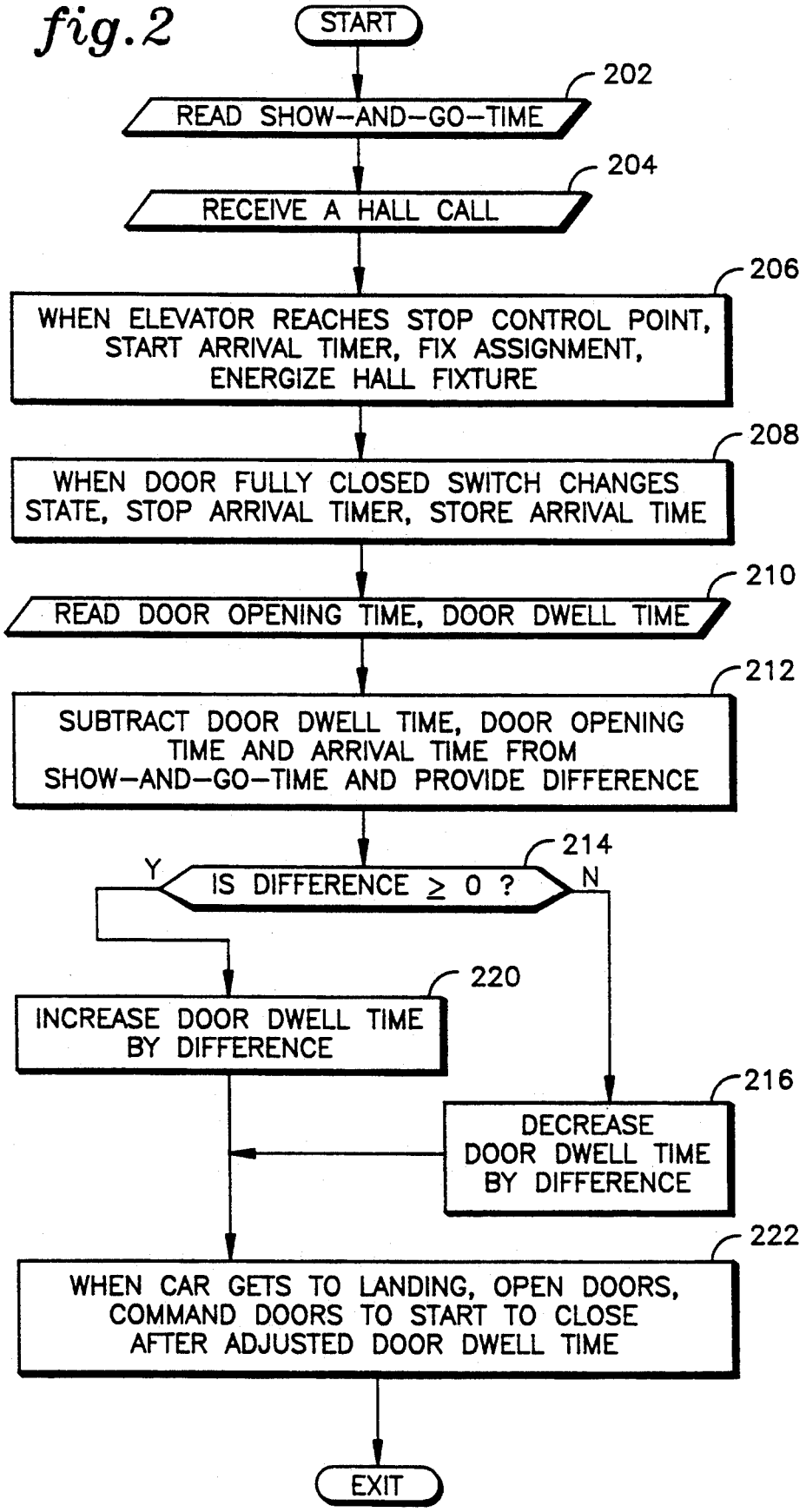
fig.2
START
202
READ SHOW-AND-GO-TIME
204
RECEIVE A HALL CALL
206
WHEN ELEVATOR REACHES STOP CONTROL POINT, START ARRIVAL TIMER, FIX ASSIGNMENT, ENERGIZE HALL FIXTURE
208
WHEN DOOR FULLY CLOSED SWITCH CHANGES STATE, STOP ARRIVAL TIMER, STORE ARRIVAL TIME
210
READ DOOR OPENING TIME, DOOR DWELL TIME
212
SUBTRACT DOOR DWELL TIME, DOOR OPENING TIME AND ARRIVAL TIME FROM SHOW-AND-GO-TIME AND PROVIDE DIFFERENCE
214
IS DIFFERENCE ≥ 0 ?
Y
N
220
INCREASE DOOR DWELL TIME BY DIFFERENCE
216
DECREASE DOOR DWELL TIME BY DIFFERENCE
222
WHEN CAR GETS TO LANDING, OPEN DOORS, COMMAND DOORS TO START TO CLOSE AFTER ADJUSTED DOOR DWELL TIME
EXIT

VARIABLE ELEVATOR DOOR DWELL TIME BASED UPON TIME OF NOTIFICATION OF ASSIGNED CAR

TECHNICAL FIELD

The present invention is directed to providing physically challenged user of an arriving elevator adequate time to enter the elevator.

BACKGROUND

Shortly before an elevator arrives at a floor, a hall fixture (a gong, or hall lantern, or both, or any device for notifying a passenger that an elevator is on its way to serve him) can be energized to show prospective passengers which elevator in a group will respond. When an elevator arrives at the floor the doors open and remain open while passengers enter, and then they close. These three steps take time: the door opening time, the time the doors remain open (door dwell time), and the door closing time. The door opening time is the time for an opening elevator door to move from a position in which the doors are fully closed and a door fully closed switch is contacted, to a position at which the doors are fully open and a door fully open switch is contacted. The door closing time is the time for a closing elevator door to move from a position in which the door is fully open and a door fully open switch is contacted, to a position in which the door is fully closed and the door fully closed switch is contacted. Whereas the majority of passengers go to the elevator quickly, some, such as the aged or physically challenged, do so more slowly. It takes these physically challenged people longer to get to the elevator once they learn which elevator in the group will respond to the hall call. The problem is how to give these exceptional passengers an exceptionally long time to get to the elevator and enter it.

Since the issue is time, the solution to the above-stated problem would seem to lie in lengthening one of the three time periods. One way to do this is to determine an average amount of time required for one of these physically challenged passengers to get to the elevator and enter it, and then lengthen the door dwell time accordingly. Unfortunately, holding the doors open for a long time holds up the elevator service not only for passengers at the floor where the physically challenged person registered the hall call but also for passengers at floors with later hall calls. For example, a five-second longer door dwell time for an elevator traveling up with hall calls at floors 5, 6, 7, 8, and 10 will take an extra 5 seconds to get to floor 6, an extra 10 seconds to get to floor 7, an extra 15 seconds to get to floor 8, and so on.

A second way would be to announce earlier which elevator will take the hall call. An elevator commits to a given hall call when it begins to decelerate to stop at the floor registering the hall call. The point at which the elevator commits to answer a hall call is the stop control point (SCP). The distance of the SCP from a registered hall call varies and is dependent upon factors including the speed of the elevator, its deceleration rate, and its position with respect to the floor. At the SCP, the elevator starts to decelerate.

In elevator dispatching systems, such as relative system response (RSR) dispatching disclosed in U.S. Pat. No. 4,363,381, the system preliminarily assigns an elevator to respond to a hall call at the time the hall call is registered. However, thereafter the RSR system can reassign a different elevator to respond to the hall call if the subsequent assignment will provide faster response or improved system performance. The reassignment process takes place in a computer in the elevator controller and is transparent to the user. In order to improve RSR dispatching efficiency, the decision regarding possible reassignment occurs often, e.g., every second. This continual reassignment process occurs until the SCP, at which point the hall call assignment is fixed with respect to a certain elevator. The SCP is the last possible moment at which the assignment may be fixed. If an elevator receives a fixed assignment beyond the SCP, the car will not have time to slow down to the floor of the hall call. As soon as the elevator assignment is fixed, the hall fixture is energized.

What this second solution gives with one hand it takes away with the other because energizing the hall fixture before the SCP requires fixing the assignment before, the SCP, confounding the purpose of fixing the assignment simultaneously with the SCP, which purpose is to reassign until the last possible moment when the assignment must be fixed.

DISCLOSURE OF THE INVENTION

An object of the present invention is to allow a physically challenged person time to go to and enter an elevator responding to his or her hall call.

The show-and-go time is the time from when the passengers are shown which elevator to board to the time when the elevator doors are ready to close after the passengers have gone into the elevator.

According to the present invention, a stored door opening time, a stored door dwell time, and a measured arrival time are subtracted from a show-and-go time. If the difference is greater than or equal to zero the door dwell time is increased by the difference, but if the difference is less than zero the door dwell time is decreased by the difference, and the doors are then held open at a landing for the new door dwell time. The advantage is that physically challenged passengers have enough time to get to and enter an elevator, while the waiting time of other passengers at subsequent floors is not unnecessarily adversely affected.

BRIEF DESCRIPTION OF THE DRAWINGS

FIG. 2 is a chart of the method of the present invention.

BEST MODE FOR CARRYING OUT THE INVENTION

Figure 1:
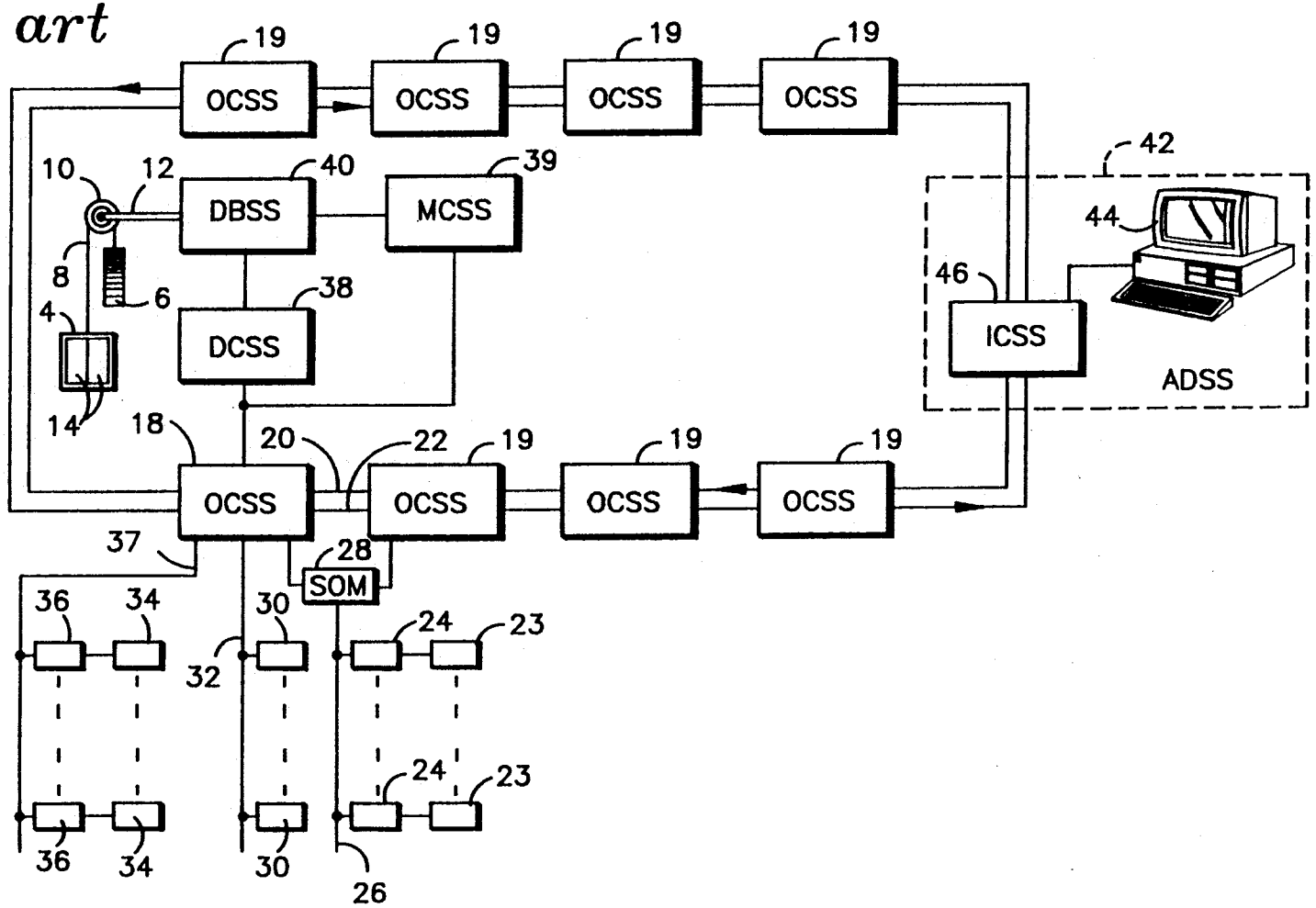
fig. 1 prior art
FIG. 1 is a block diagram depicting an exemplary elevator control system.

The present invention can be used with the elevator control system shown in U.S. Pat. No. 4,363,381 to Bittar, incorporated herein by reference or the ring system described in DE/EP 0,239,662 to Auer et al., published Oct. 7, 1987 (corresponding to allowed U.S. Ser. No. 029,495, filed Mar. 23, 1987, also incorporated by reference) similar to the one shown in FIG. 1.

FIG. 1 shows a half duplex ring communication system 1 (or simply "ring"). An elevator 4 and a counterweight 6 are suspended by a rope 8 hung over a sheave 10, rotatable by a shaft 12. The elevator 4 includes doors 14. Each elevator 4 has OCSS's 18, 19 which communicates with every other OCSS 18 in the half-duplex ring communication system via lines 20, 22.

Hall call buttons 23 provide hall call signals to OCSSs 18, 19 and receives signals from the OCSS 18 via remote stations 24, a remote serial communication link 26, and switch-over module 28. Elevator buttons (not shown) are connected to the OCSS 18 via a remote station 30 and a remote serial communication link 32, as shown in U.S. Pat. No. 4,497,391 "Modular Operational Elevator Control System". Hall fixtures 34 indicating the elevator direction of travel provide signals to the OCSS 18 and receive signals from the OCSS 18 via remote stations 36 and a remote serial communication link 37.

Operation of the doors 14 is controlled by a door control subsystem computer (DCSS) 38. The door opening and door dwell times are stored in the OCSS 18. The door dwell time is the time from when a door fully open switch (not shown) changes from a first state to when the door fully open switch returns to that first state. The door opening time is the time from when a door fully closed switch (not shown) changes from a first state to the time when that door fully open switch returns to that state. Control of a door 14 with the aid of a computer is well known. See, for example, "Elevator Door Motion Mode Control", U.S. Pat. No. 4,300,663. The movement of the elevator 4 is controlled by a motion control subsystem (MCSS) 39, which operates in conjunction with a drive and brake subsystem (DBSS) 40. Motion control is well known in the art: see for example "Electronic Motion Control System for Elevators", U.S. Pat. No. 3,743,055; as is a drive and brake control, see for example "Drive Control for an Elevator", U.S. Pat. No. 4,337,847; and "Elevator Brake Control Method of Arrangement", U.S. Pat. No. 4,586,587. Each OCSS 18, 19 has equipment 23–40 which responds to signals from the OCSS 18 and provides signals to the OCSS 18. For simplicity, only the equipment 23–40 associated with one OCSS 18 has been described. Elevator dispatching is determined and executed by the OCSS 18 with additional inputs generated by advanced dispatching routines in an advanced dispatching subsystem (ADSS) 42 including a computer 44 using an information control subsystem (ICSS) 46, which is a computer for exchanging data with the ring. The point at which the elevator commits to answer a hall call is the stop control point (SCP). The distance of the SCP from a registered hall call varies and is dependent upon factors including the speed of the elevator, its deceleration rate, and its position with respect to the floor. At the SCP, the elevator starts to decelerate in response to an SCP signal from the MCSS 39.

The DCSS 38 determines the load of the elevator 4, with the load being converted into user boarding and/or deboarding rates by the MCSS 39. This information can be sent to the ADSS 42 for recordation and prediction of traffic flow in order to increase the efficiency of elevator service. Alternatively, user boarding and/or deboarding rates can be determined by a people sensing/counting arrangement as shown, for example, in U.S. Pat. No. 4,799,243 issued to Zepke (assigned to the same assignee as the present invention) and incorporated herein by reference.

FIG. 2 shows the process of regulating the elevator door 14. Initially, a signal indicative of a show-and-go time is selected, step 202. The show-and-go time is the limit on the sum of the arrival time, door open time, and door dwell time. This time may be varied according to the number of disabled occupants in the building and the extent of their disabilities; for example, the show-and-go time may be longer in a nursing home than in an office building.

The arrival time can be measured in at least two ways. Both determine the time for the elevator 4 to get from the SCP to the time that a door fully closed switch changes state, indicating that the doors are no longer fully closed and therefore are beginning to open. One way is for an arrival timer in the OCSS 18 to be started when the elevator 4 reaches the SCP and begins to decelerate. The arrival timer is stopped when a door fully closed switch changes state, indicating that the doors are beginning to open.

A second way to measure the arrival time is by calculating it as twice the square root of the distance-to-go divided by the elevator deceleration. The deceleration profile of the elevator 4 is calculated in the MCSS as a function of the acceleration profile of the elevator 4 while that acceleration profile is being constructed. The distance-to-go is obtained by subtracting from a look-up table the distance the elevator 4 has traveled from the floor it last passed. The look-up table is made during installation when the elevator 4 runs from one end of the hoistway to the other, measuring the distance between successive floors. This method is limited to situations where the deceleration of the elevator 4 is constant from the SCP until the car stops.

A hall call signal is received in the OCSS, step 204. When the elevator 4 reaches the SCP, the arrival timer is started, the elevator 4 is assigned to the hall call, and a hall lantern 34 is energized, step 206. The hall fixture may be a hall lantern and/or a gong or any device for notifying a prospective passenger that an elevator will soon serve him in response to the hall call signal. Several techniques for the hall call assignment are known, for example up-peak, down-peak and noon-time, and dispatching based on bonuses and penalties, for example, the RSR method disclosed in U.S. Pat. No. 4,815,568 or U.S. Pat. No. 4,363,381, both of which are incorporated herein by reference. In step 208, the arrival timer is stopped and a signal indicative of the arrival time is stored. In step 210, signals indicative of predetermined door opening time and door dwell time are read. Measuring the arrival time signal, steps 206, 208, and door opening time signal, step 210, together constitute measuring a signal indicative of the time from when said hall fixture is energized to when the door of the elevator is fully open. In step 212, the door dwell time, door opening time, and arrival time signals are subtracted from the show-and-go time and a difference signal is obtained. In step 214, the difference is compared to zero. If the difference is not greater than or equal to zero, test 214 negative, the door dwell time is decreased by the difference, step 216 thereby providing an adjusted door dwell time signal. If the difference is greater than or equal to zero, test 214 affirmative, the door dwell time is increased by the difference, step 220, thereby providing an adjusted door dwell time signal.

At this point, the sum of the door dwell time, the arrival time, and the door opening time signals is equal to the signal indicative of the show-and-go time so that service is not compromised by an overly long wait for passengers in the hall. Now that the door dwell time is correct, the door dwell time is set to the adjusted value as described above. Therefore, in step 222, when the elevator 4 arrives at a landing and the doors 14 are opened, the doors 14 start to close in response to the adjusted door dwell time signal, after the adjusted door dwell time expires. For example, if the show-and-go time given is ten seconds, the door dwell time is five seconds, the door opening time is one second, and the arrival time is three seconds, then the door dwell time will be increased to six seconds.

Although illustrative embodiments of the present invention have been described in detail with reference to the accompanying drawings, it is to be understood that the invention is not limited to those precise embodiments. Various changes or modifications may be effected herein without departing from the scope or spirit of the invention.

We claim:

1. A method of controlling a door of an elevator, comprising:

energizing a hall fixture at a floor, in response to a hall call signal, for notifying a prospective elevator passenger that said elevator will arrive at said floor;

measuring a signal indicative of the time from when said hall fixture is energized to when a door of said elevator is fully open;

adjusting a signal indicative of a predetermined door dwell time, in response to said signal indicative of the time from when said hall fixture is energized to when said door is fully open for providing an adjusted door dwell time signal indicative of an adjusted door dwell time, wherein said door dwell time is equal to the time that said door is in the open;

starting to close said door in response to said adjusted door dwell time signal and after expiration of said adjusted door dwell time.

2. A method of controlling a door of an elevator, comprising:

energizing a hall fixture at a floor, in response to a hall call signal, for notifying a prospective elevator passenger that said elevator will arrive at said floor;

measuring a signal indicative of the time from when said hall fixture is energized to when a door of said elevator is fully open;

starting to close said door a selected time after said hall fixture has been energized, wherein said time is selected in response to said signal.

3. A method of controlling a door of an elevator, comprising:

energizing a hall fixture at a floor, in response to a hall call signal, for notifying a prospective elevator passenger that said elevator will arrive at said floor;

reading a show and go time, indicative of a time from when the hall fixture is energized to the time said door is to begin closing;

measuring a signal indicative of the time from when said hall fixture is energized to when a door of said elevator is fully open;

subtracting said signal indicative of the time from when said hall fixture is energized to when a door of said elevator is fully open from said signal indicative of said show and go time and providing a difference signal;

starting to close said door in response to said difference signal.

4. A method of controlling a door of an elevator, comprising:

energizing a hall fixture at a floor, in response to a hall call signal, for notifying a prospective elevator passenger that said elevator will arrive at said floor;

measuring a signal indicative of arrival time of said elevator, wherein said arrival time is the time from when said hall fixture is energized to when said door starts to open;

reading a signal indicative of door dwell time of said elevator;

reading a signal indicative of door opening time of said elevator;

adding said arrival time signal, said door opening time signal, and said door dwell time signal for providing a sum;

subtracting said sum from a show-and-go time, indicative of a time from when the hall call fixture is energized to the time said door is to begin closing, and providing a difference signal;

providing an adjusted door dwell time signal indicative of an adjusted door dwell time in response to said difference signal;

after said door has opened, holding said door open until said adjusted door dwell time has expired;

staring to close said door in response to said adjusted door dwell time signal and after expiration of said adjusted door dwell time.

5. The method of claim 1, wherein said signal indicative of the time from when said hall fixture is energized to when said door of said elevator is fully open is equal to a door opening time and an arrival time of said elevator, wherein said arrival time is the time from when said hall fixture is energized to when said door starts to open.

6. The method of claim 2, wherein said signal indicative of the time from when said hall fixture is energized to when said door of said elevator is fully open is equal to a door opening time and an arrival time of said elevator, wherein said arrival time is the time from when said hall fixture is energized to when said door starts to open.

7. The method of claim 3, wherein said signal indicative of the time from when said hall fixture is energized to when said door of said elevator is fully open is equal to a door opening time and an arrival time of said elevator, wherein said arrival time is the time from when said hall fixture is energized to when said door starts to open.

* * * * *